US005738466A

United States Patent [19]

Ashmore et al.

[11] Patent Number: 5,738,466

[45] Date of Patent: Apr. 14, 1998

[54] RIBBED FLEXIBLE MEMBER FOR CASTING INTO AN ANCHORAGE MEDIUM

[75] Inventors: Peter Stuart Ashmore; John Mawson Walton, both of Doncaster, England

[73] Assignee: Bridon plc, South Yorkshire, England

[21] Appl. No.: 424,317

[22] PCT Filed: Aug. 5, 1994

[86] PCT No.: PCT/GB94/01726

§ 371 Date: Jul. 26, 1995

§ 102(e) Date: Jul. 26, 1995

[87] PCT Pub. No.: WO95/05526

PCT Pub. Date: Feb. 23, 1995

[30] Foreign Application Priority Data

Aug. 16, 1993 [GB] United Kingdom ..... 9317017

[51] Int. Cl.[6] ..... E21D 21/00; F16B 39/36

[52] U.S. Cl. ..... 405/302.2; 57/215; 405/259.1; 405/259.5

[58] Field of Search ..... 405/302.2, 259.2, 405/259.6, 259.1; 57/212, 213, 215, 217, 311

[56] References Cited

U.S. PATENT DOCUMENTS

| | | | |
|---|---|---|---|
| 4,781,016 | 11/1988 | Sato et al. | 57/212 X |
| 5,230,589 | 7/1993 | Gillespie | 405/259.5 X |
| 5,378,087 | 1/1995 | Locotos | 405/302.2 X |
| 5,458,442 | 10/1995 | Ashmore | 405/302.2 |

FOREIGN PATENT DOCUMENTS

| | | | |
|---|---|---|---|
| 1061571 | 4/1954 | France | 57/144 |
| 977536 | 11/1982 | U.S.S.R. | 57/212 |
| WO 93/03256 | 2/1993 | WIPO . | |

*Primary Examiner*—Tamara L. Graysay
*Assistant Examiner*—Tara L. Mayo
*Attorney, Agent, or Firm*—Cesari and McKenna

[57] ABSTRACT

A ribbed flexible member for casting into an anchorage medium includes a central strand with outer wires extending helically about the strand. Parts of the exposed surfaces of some of the outer wires are indented in a non-axial direction, those parts being distributed along the strand.

9 Claims, 1 Drawing Sheet

RIBBED FLEXIBLE MEMBER FOR CASTING INTO AN ANCHORAGE MEDIUM

This invention relates to a ribbed flexible member comprising a strand including outer wires extending helically, for casting into an anchorage medium.

In particular the invention relates to the tensile reinforcing members, known as "roof bolts", which are used in underground mining operations for the purpose of stabilization of the rock strata, for example roof support when tunnelling. In service, the bolts are used in a procedure which comprises: boring holes into the rock strata; introducing bolts which extend axially along the length of the holes; and injecting a settable grouting material (anchorage medium) into each hole so as to substantially fill the voids between the bolt and the hole. The depth and direction of the holes are such that the bolt extends from potentially unstable rock strata into areas of rock which are known to be stable, thus stabilizing the rock (e.g. the roof) which was liable to collapse. This objective may be further advanced by attaching a nut and washer to the inboard end of the bolt so that it directly bears upon and supports the inner rock face. After the grouting material has hardened, the nut may be tightened so as to pre-tension the bolt.

It is known to use wire ropes, cables, or strands as roof bolts. Such bolts are preferably rotated as they are driven into the holes, so as to tighten the rope or strand.

The present invention provides a ribbed flexible member for casting into an anchorage medium, comprising a strand including outer wires extending hellically, in which parts of the exposed surfaces of a plurality of the outer wires are indented in a substantially non-axial direction, the said indented parts being distributed along the strand.

The indented parts provide a mechanical key, thereby enhancing keying to the anchoring medium and resisting the otherwise natural tendency of the strand to screw out of the anchoring medium. Preferably, the anchoring medium (e.g. a resin or a cementitious grout) can penetrate between the outer wires into the interstices of the strand.

In preferred embodiments some (e.g. at least half) or all of the outer wires are indented, the indentations being distributed along the wires. The indentations are preferably longer than the intervening lands. The wires may be indented before or after the strand is formed.

In a preferred embodiment the strand includes inner wires extending helically. Preferably the strand is of equal-lay construction; in this case the outer wires may be spaced apart. The inner wires (and any axially-extending "king wire") may be smooth.

In particular, the invention provides a strand of 1×19 (9/9/1) construction in which the outer wires are indented and uniformly spaced apart.

In one embodiment the strand has a compacted structure in which, in cross-section, the outer wires have external edges which are arcs of a circle circumscribing the strand, and the outer surface of the strand has indentations, e.g. formed by a rolling operation carried out on the compacted strand.

In each case the strand may have a load-bearing termination, such as a pressed tubular sleeve or ferrule, which can transmit the stabilising tensile force directly onto the open face of the sidewall or roof of a tunnel.

The invention will be described further, by way of example, with reference to the accompanying drawings, in which.

Figure 1:
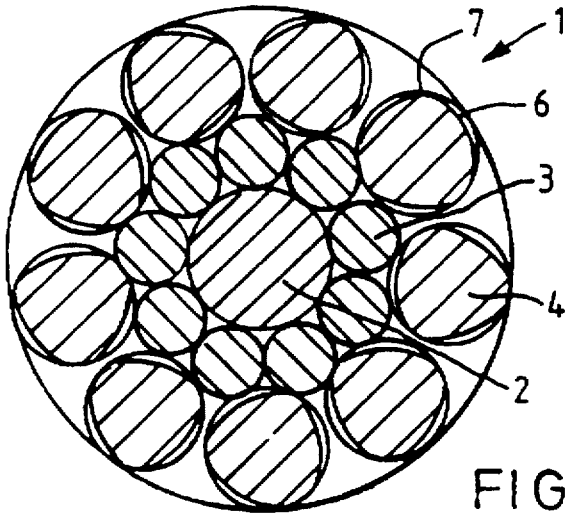
FIG. 1 is a cross-section through a roof bolt comprising a steel-wire strand.
Figure 2:
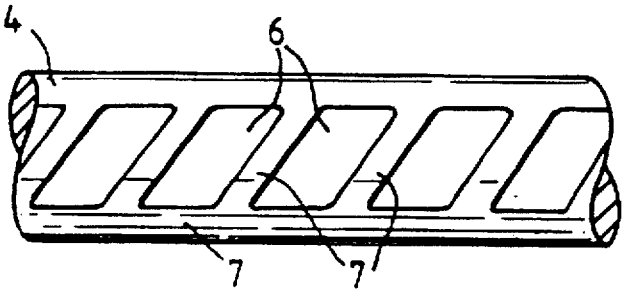
FIG. 2 is an enlarged partial side view of one of the outer wires of the strand.
Figure 3:
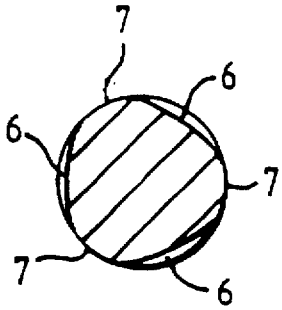
FIG. 3 is a diagrammatic cross-section of the wire shown in FIG. 2.

The roof bolt illustrated in FIGS. 1 to 3 (and also FIG. 6) comprises a strand 1 of 1×19 (9/9/1) construction, including a king wire 2, an inner layer of nine helically-extending wires 3, and an outer layer of nine helically-extending wires 4. The inner and outer layers are of equal helical lay and the outer wires 4 are equally spaced apart. The wires 2 and 3 are smooth round wires, while the outer wires 4 have indentations 6 separated by narrower lands 7. Although the cross-sectional view in FIG. 3 shows the indentations 6 at the same axial location, the indentations may be staggered. Three rows of indentations may be formed in the wire by a three-rollers head system, or alternative (e.g. two-roller) arrangements may be used.

Figure 4:
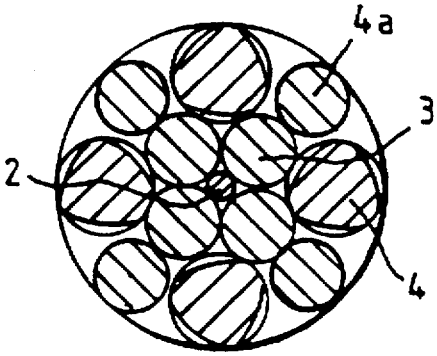
FIG. 4 is a cross-section through a second embodiment of the roof bolt.

FIG. 4 shows an equal-lay strand of 1×13 (4&4/4/1) construction with four identical, indented wires 4 on the outer layer. The remaining outer wires 4*a*, the inner wires 3, and the (optional) king wire 2 are smooth round wires.

Figure 5:
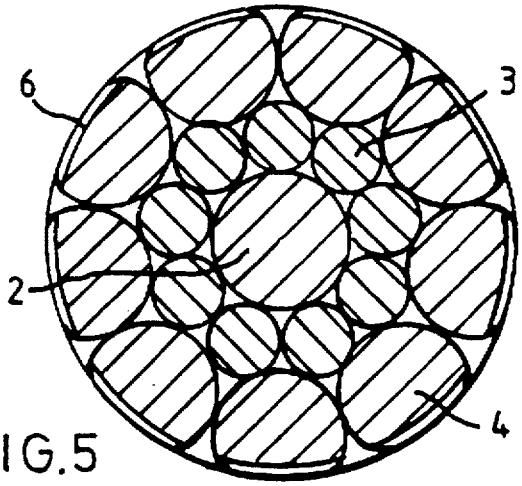
FIG. 5 is a cross-section through a third embodiment of the roof bolt.

FIG. 5 shows a compacted strand of 1×19 (9/9/1) construction which has been peripherally indented after stranding. In this case the indentations 6 may constitute annular grooves (as shown) or helical grooves around the strand.

Figure 6:
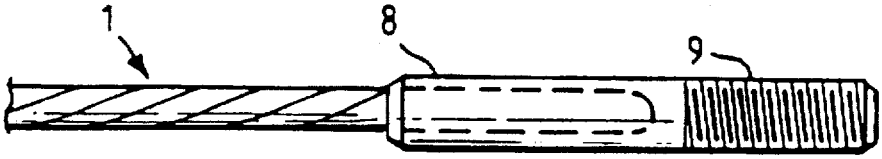
FIG. 6 is a side view of a roof bolt, showing an attachment member.

As shown in FIG. 6, an attachment ferrule 8 including a screwthreaded portion 9 is pressed or swaged on one end of the strand 1. The other end of the strand may be "pointed", e.g. by hot twisting off, in order to assist entry and insertion.

In another embodiment (not shown) the ferrule is of polygonal external cross-section, or has external facets, in the manner of a nut, which shape can be achieved during the pressing operation. Such a ferrule can be used to drive the strand into the hole (by applying axial force and torque in the preferred strand-tightening direction) until the ferrule is tight up against a thrust washer.

The ribbed flexible member described above is not limited to use as a roof bolt but can be used in any situation in which a tensile member is required to be cast into an anchoring medium.

We claim:

1. A ribbed flexible member for casting into an anchorage medium, comprising a strand including outer wires extending helically, in which the exposed surfaces of a plurality of the outer wires are indented, the indentations being distributed along the length of the strand to receive the anchorage medium.

2. A ribbed flexible member as claimed in claim 1, in which the strand includes inner wires extending helically.

3. A ribbed flexible member as claimed in claim 2, in which the strand is of equal-lay construction.

4. A ribbed flexible member as claimed in claim 3, in which the outer wires are spaced-apart.

5. A ribbed flexible member as claimed in claim 1, in which each indented wire has indentations which are separated in the circumferential and axial directions by intervening lands.

6. A ribbed flexible member as claimed in claim 5, in which the lands are narrower than the indentations.

7. A ribbed flexible member as claimed in claim 1, in which the strand has a compacted structure in which, in cross-section, the outer wires have external edges which are arcs of a circle circumscribing the strand, and the outer surface of the strand has indentations, distributed along the strand.

8. A roof bolt comprising a ribbed, flexible member for casting into an anchorage medium, said member comprising a strand including outer wires extending helically, in which the exposed surfaces of a plurality of the outer wires are indented, the indentations being distributed along the length of the strand to receive the anchorage medium.

9. A roof bolt as claimed in claim 8, having a load-bearing termination on one end of the strand.

* * * * *